US005088591A

United States Patent [19]

Grecksch et al.

[11] Patent Number: 5,088,591

[45] Date of Patent: Feb. 18, 1992

[54] TUBE TRANSPORT ASSEMBLY FOR TRANSPORTING YARN PACKAGES ON A TEXTILE MACHINE INCLUDING A VERTICAL TRANSPORT COMPONENT

[75] Inventors: Hans Grecksch; Dieter Spinnen, both of Moenchen-gladbach, Fed. Rep. of Germany

[73] Assignee: W. Schlafhorst AG & Co., Moenchen-gladbach, Fed. Rep. of Germany

[21] Appl. No.: 699,452

[22] Filed: May 13, 1991

[30] Foreign Application Priority Data

May 11, 1990 [DE] Fed. Rep. of Germany ..... 4015173

[51] Int. Cl.[5] ..... B65G 29/00

[52] U.S. Cl. ..... 198/465.1; 198/487.1; 242/35.5 A

[58] Field of Search ..... 198/465.1, 487.1, 803.01, 198/803.12; 242/35.5 A

[56] References Cited

U.S. PATENT DOCUMENTS 4,776,468 10/1988 Kiriake .
4,781,287 11/1988 Fukushima .
4,830,171 5/1989 Kupper ..... 242/35.5 A X
4,842,206 6/1989 Kawasaki et al. .
4,897,992 2/1990 Kogiso et al. ..... 198/487.1 X

FOREIGN PATENT DOCUMENTS 0466153 9/1928 Fed. Rep. of Germany ... 198/465.1
2603165 7/1976 Fed. Rep. of Germany .
52-25139 2/1977 Japan .
56-6952 2/1981 Japan .
90-03460 4/1990 PCT Int'l Appl. .
1170660 11/1969 United Kingdom .

*Primary Examiner*—Joseph E. Valenza
*Assistant Examiner*—Tuan N. Nguyen
*Attorney, Agent, or Firm*—Shefte, Pinckney & Sawyer

[57] ABSTRACT

A tube transport assembly is provided for transporting yarn packages on a textile machine. The tube transport assembly includes a vertical transport component for transporting yarn packages between vertically spaced locations. Each yarn package, which is in the form of yarn built on a tube, is individually fixedly supported on a tube support member and each tube support member includes an engagement portion for engagement by a post of a carrier member to thereby effect support of the tube support member by the carrier member. The carrier members are mounted to a flexible endless belt at uniform spacings therealong and are moved in an upward run past a feed location at which tube support members are fed to the carrier members for engagment and support thereby. A pair of transfer plates at the feed location guide the tube support members being engaged by the carrier members to insure that the tube support members are fully seated on the carrier members. The tube transport assembly also includes a pair of release guide plates at a discharge location for effecting release of the tube support members from the carrier members.

20 Claims, 4 Drawing Sheets

TUBE TRANSPORT ASSEMBLY FOR TRANSPORTING YARN PACKAGES ON A TEXTILE MACHINE INCLUDING A VERTICAL TRANSPORT COMPONENT

BACKGROUND OF THE INVENTION

The present invention relates to an assembly for transporting tubes of the type on which yarn is wound on a textile machine, and more particularly, to an assembly which includes a vertical transport component for transporting the tubes between vertically-spaced locations.

Japanese Patent Document JP OS 52-25 139 discloses a tube transport system by which full yarn packages and empty tubes, each individually supported in an upright disposition on a tube support member, are transported between vertically spaced locations. Horizontal transport components transport the tube support members to transfer locations at which the tube support members are transferred to the vertical transport component for vertical transport between the vertically spaced locations. The vertical transport component includes an elevator or lift device which selectively lifts or lowers a plurality of the tube support members at the same time. The elevator or lift device operates in a discontinuous manner and, for this and other reasons, the transport system disclosed in this prior art reference is not well-suited for transporting a relatively high volume of tube support members.

German Patent Document DE-PS 36 09 071 also discloses a discontinuously operating transport system for transporting tube support members on which full yarn packages or empty tubes are individually supported in upright dispositions. This prior art transport system likewise suffers from the disadvantage that a relatively high throughput of tube support members is difficult to obtain.

U.S. Pat. No. 4,842,206 to Kawasaki et al discloses a transport system for independently movable tube support members on which full yarn packages and empty tubes are individually supported in upright dispositions. The transport system includes a pair of resilient guides for clamping a projection of each tube support member or peg tray 1 therebetween and for pressing a bottom face of the respective peg tray against a conveyor belt. The resilient guides extend in a twisted condition relative to the conveyor belt and this arrangement effects twisting of the peg trays and the bobbins supported thereon during conveyance of the peg trays by the conveyor belt. The resilient guides change the orientation of the peg trays through approximately 90° as the peg trays are transported by the conveyor belt through a generally right-angled turn. However, the resilient guides must exert a relatively high pressing force on the peg trays to maintain the peg trays in sufficient frictional engagement with the conveyor belt to insure that the conveyor belt conveys the peg trays therewith.

This situation detrimentally leads to relatively significant wear on the surfaces of the peg trays in frictional engagement with the resilient guides and the conveyor belt, thereby necessitating corresponding maintenance and/or replacement services. Accordingly, the need exists for a transport assembly for transporting tube support members on a textile machine through horizontal and vertical runs which advantageously permits a relatively high throughput of tube support members, minimizes space requirements, and insures a reliable transport of the tube support members.

SUMMARY OF THE INVENTION

Briefly described, the present invention provides an assembly for transporting tubes in association with a textile machine, the tubes being of the type on which yarn is wound. The assembly includes a plurality of tube support members, each tube support member for individually supporting a tube thereon in a fixed disposition relative to the tube support member and each tube support member having an engagement portion and a vertical transport component for transporting tube support members along a transport path which includes at least on portion extending between vertically spaced locations.

The vertical transport component includes a carrier member conveying means operable to travel in an endless loop between a feed location at which tube support members are transferred to the carrier member conveying means and a discharge location at which tube support members being transported by the carrier member conveying means are transferred therefrom, the endless loop in which the carrier member conveying means travels defining a travel plane and the carrier member conveying means traveling upwardly at the feed location and traveling downwardly at the discharge location. The vertical transport component also includes a plurality of carrier members secured to the carrier member conveying means at spacings therealong, each carrier member for individually supporting a tube support member during transport of the tube support member by the carrier member conveying means, and each carrier member has a re-orientation movement support portion for cooperating with the engagement portion of a tube support member to support the tube support member during a re-orienting movement thereof in which the tube support member moves relative to the carrier member from its feed position orientation to a travel position orientation in which the tube support member is oriented at a greater angle relative to the horizontal.

The assembly also includes means for supporting tube support members at the feed location in position for sequential individual engagement of each tube support member by a respective one of the carrier members and means for guiding each tube support member in the lateral direction during upward movement of the tube support member at the feed location in correspondence with the engagement of the tube support member by a respective carrier member, the guiding means effecting complete seating of the engaged tube support member on the respective carrier member. Also, the assembly includes means for effecting release of tube support members from the downwardly moving carrier members at the discharge location.

Preferably, the engagement portion of each tube support member includes an opening on the bottom of the tube support member and the re-orienting movement support portion of each carrier member is adapted to be inserted within the opening of each tube support member during movement of the carrier member past the feed location for initial engagement of the tube support member by the carrier member.

According to one embodiment of the assembly, the engagement portion of each tube support member includes an outer member, an inner member, and a plurality of spoke members interconnecting the inner member to the outer member at a spacing therebetween, each adjacent pair of the spoke members, the outer member, and the inner member forming an opening for the insertion therein of the re-orienting movement support portion of a carrier member for initial engagement of the tube support member by the carrier member.

According to one aspect of the present invention, the assembly also includes a feed transport component having a flexible endless member for traveling support of tube support members thereon, the flexible endless member extending to the feed location for the transport of tube support members to the feed location and means for inclining the orientation of the flexible endless member relative to the horizontal at the feed location for transfer of tube support members in inclined orientation to the carrier members. In a further aspect of the present invention, the assembly additionally includes means for releasably maintaining a tube support member at the feed location in position for engagement of the tube support member by a carrier member.

In an additional aspect of the present invention, the means for guiding each tube support member includes a pair of transfer guide plates, the transfer guide plates being spaced apart from one another for travel of the carrier member conveying means therebetween, and each transfer guide plate extending laterally outwardly from the travel plane in the direction from its upper end toward its lower end. Also, the assembly further includes a guide roller and an offset guide roller, the guide roller and the offset guide roller cooperating together to guide the carrier member conveying means in a portion of the transport path which is inclined with respect to the vertical the inclined transport path portion extending between the spaced-apart transfer guide plates.

According to a further aspect of the present invention, the vertical transport component includes a guide roller and an offset guide roller, the carrier member conveying means being trained around the guide roller and the offset guide roller, and the guide roller and the offset guide roller cooperating together to guide the carrier conveying means in an inclined travel path inclined from the vertical at the outgoing transfer location.

According to yet another aspect of the present invention, the assembly further includes a discharge transport component for transporting tube support members transferred from the vertical transport component at the discharge location, the discharge transport component having a substantially horizontal surface for supporting tube support members thereon. The lower end of the release guide plate member preferably tapers at an increasingly reduced angle relative to the horizontal for effecting relatively smooth transfer of tube support members from the lower end of the release guide plate member onto the substantially horizontal surface of the discharge transport component.

In a further additional aspect of the present invention, each tube support member has a ferro magnetic component and each carrier member has a magnetic component operable to magnetically interact with the ferro magnetic component of a tube support member engaged by the carrier member to thereby minimize relative movement between the carrier member and the respective tube support member supported thereon during movement of the carrier member and the tube support member by the carrier member conveying means.

In the one aspect of the present invention, the re-orienting movement support portion of each carrier member preferably includes means defining a notch for initially engaging a tube support member, the notch being open in the direction of travel of the carrier member conveying means at the feed location for receiving therein a portion of a tube support member to thereby reduce the risk of lateral outward movement of the tube support member beyond the re-orienting movement support portion of the carrier member.

According to yet a further additional aspect of the present invention, the vertical transport component includes a plurality of guide rollers for guiding the carrier member conveying means in the transport path, the guide rollers guiding the carrier member conveying means in a first upward run on one side of a service passageway, a first horizontal run extending over the service passageway, a first downward run, a second upper run on the opposite side of the service passageway, a second horizontal run over the service passageway, and a second downward run on the one side of the service passageway, whereby the vertical transport component transports tube support members in bridging manner over the service passageway. The assembly also preferably includes means for transferring tube support members from the second downward run of the carrier member conveying means and means for feeding tube support members to the carrier member conveying means at a second feed location, the feed location and the second discharge location being located on the same side of the service passageway and the second feed location and the discharge location being located on the opposite side of the service passage way as the feed location in the second discharge location.

DESCRIPTION OF THE PREFERRED EMBODIMENTS

Figures 1, 2, 3:
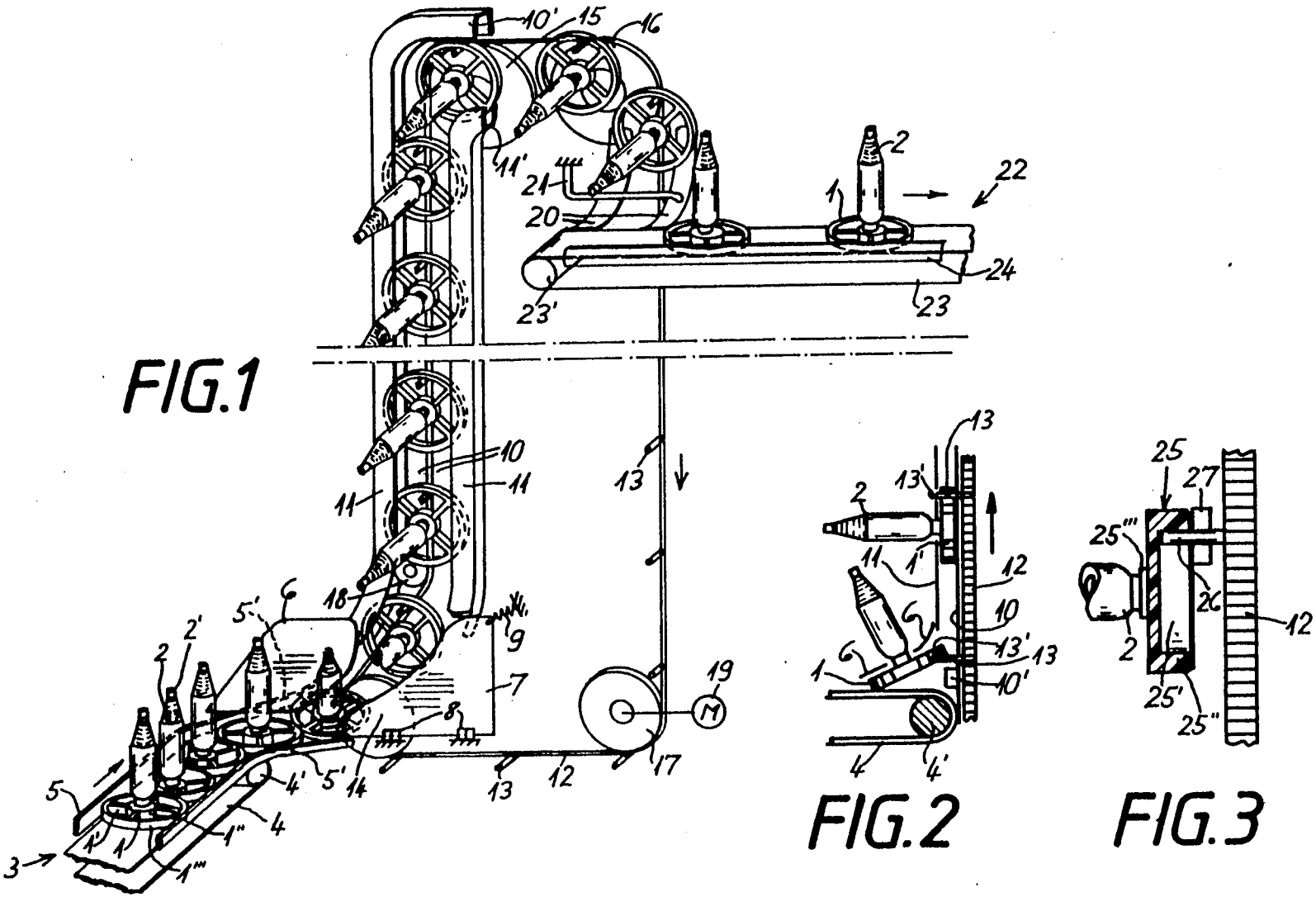
FIG. 1 is a top plan view of one embodiment of the tube transport assembly of the present invention.
FIG. 2 is a side elevational view, in partial vertical sections, of a portion of the tube transport assembly shown in FIG. 1.
FIG. 3 is an enlarged side elevational view, in vertical section, of a portion of the tube transport assembly shown in FIG. 2, and showing a variation of the carrier member.

In FIG. 1 and 2, one embodiment of the tube transport assembly of the present invention is illustrated in its operating disposition for transporting a plurality of tube support members 1 between textile machine locations. The tube support members 1 each include, as seen in FIG. 1, an outer member or annular ring 1''', an inner member or peg support portion 1'', and a plurality of spokes 1', each at a right angle from the adjacent spokes for fixedly interconnecting the peg support portion 1'' to the annular ring 1''' with the peg support portion 1'' centered on the axis of the annular ring 1'''. The peg support portion 1'' includes a peg compatibly configured with the inner diameter of a tube 2' for snugly receiving the tube 2' inserted thereon to effect support of the tube in fixed disposition to the tube support member 1 throughout horizontal and vertical transport thereof. The tube 2' is of the type on which yarn is built by a textile machine to form a full yarn package 2.

The tube transport assembly includes a feed transport component 3 for transporting tube support members to a feed location and having a conventional flexible endless member or belt 4 trained around a guide roller 5' at its downstream end and around a conventional drive roller (not shown) operatively connected to a conventional drive motor (not shown) for driving operation of the belt 4. Additionally, the feed transport component 3 includes a pair of guide walls 5 extending parallel to one another each on a respective side of the top run of the belt 4 for maintaining the tube support members supported on the belt 4 in centered dispositions on the belt. Each guide wall 5 includes a portion 5' extending beyond the downstream end of the belt 4 relative to the direction of travel of the tube support members 1 for guiding of the tube support members as they exit the belt 4.

The tube transport assembly also includes a vertical transport component having a carrier member conveying means in the form of an endless member or belt 12 trained around a plurality of guide rollers 14, 15, and 16 and a drive roller 17 for driving movement of the belt 12 in an endless loop disposed in a vertical travel plane. The drive roller 17 is operatively connected to a conventional belt drive motor 19 for continuous driving operation of the belt 12 in the direction shown by the arrow in FIG. 1. The belt 12 includes a plurality of carrier members 13 mounted thereto at uniform spacings along the belt for individually carrying the tube support members 1 for transport of the tube support members by the belt 12 between the feed location and a discharge location at which a discharge transport component 22, which is vertically spaced from the feed transport component 3.

The vertical transport component additionally includes a pair of generally C-shaped guide channels 11 for guiding of the tube support members during their transport by the vertical transport component. Each guide channel 11 includes a rear surface portion 10 for sliding engagement of the bottom surface of the tube support members 1 therealong during guiding engagement of the tube support members by the guide channels 11. The belt 12 travels between the rear surface portions 10 of the guide channels during its upward run. One of the guide channels 11 includes a horizontal portion 10' and the guide channel 11 includes a horizontal portion 11', the horizontal portions 10',11' for guiding and supporting the tube support members 1 during their transport along the upper horizontal run of the belt 12 between the guide rollers 15 and 16 to thereby reduce the force on the carrier members 13 due to the mass of the supported tube support members 1 acting thereon. As seen in FIG. 1, the horizontal portion 11', which is only partially shown for clarity of illustration, is operable to support the lowermost outer circumferential surface of the annular ring 1''' of each tube support member 1 as the tube support member is transported by its associated carrier member 13 along the upper horizontal run of the belt 12. Each carrier member 13 includes a re-orienting movement support position is in the form of a cylindrical post extending from the belt 12 in a direction transverse to the vertical plane in which the belt 12 moves. As best seen in FIG. 2, each carrier member 13 includes a notch 13' formed adjacent the free end of the carrier member post and open in the direction of movement of the belt 12. The notch 13' of each carrier member 13 facilitates engagement of a tube support member 1 by the carrier member in a manner described in more detail below. The discharge transport component 22 includes a conventional flexible endless member or belt 23 trained around a guide roller 23' at its upstream end and around a conventional driver roller (not shown) at its downstream end, the conventional drive roller being operatively connected to a conventional drive motor (not shown) for driving movement of the belt 23 in the direction shown by the arrow in FIG. 1. The upper run of the belt 23 extends in a direction parallel to the vertical plane in which the belt 12 moves and is disposed at a level vertically spaced from the level at which the belt 4 of the lower horizontal transport component 3 is disposed. The discharge transport component 22 preferably includes a guide wall 24 extending along at least one side of the upper run of the belt 23 for maintaining the tube support members 1 in centered dispositions on the belt 23 during their transport thereby.

The tube transport assembly additionally includes means for supporting the tube support members 1 at the feed location in position for sequential individual engagement of each tube support member by the vertical transport component including a pair of transfer guide plates 6,7, each of which is mounted to a frame of the textile machine (not shown). The mounting of the transfer guide plates 6,7 to the frame of the textile machine is representatively shown by the mounting of the transfer guide plate 7 to the frame by a pair of spaced apart hinges 8 mounted to the lower portion of the transfer guide plate 7 and a spring element 9 having one end mounted to an upper portion of the transfer guide plates and its other end mounted to the frame of the textile machine.

As seen in FIG. 2, the upper portion of each transport guide plate 6,7 extends in overlapping relation with the lower portion of a respective one of the guide channels 11 and each transfer guide plate 6,7 is adapted to cooperate with the feed transport component 3 and the vertical transport component during transfer of each tube support member 1 therebetween to insure that the tube support member 1 being transferred is reliably engaged by the respective carrier member on the belt 12 during the transfer operation. Each transfer guide plate 6,7 is preferably formed out of metal plate.

The tube transport assembly additionally includes means for effecting the release of each tube support member 1 from the vertical transport component including a pair of release guide plates 20 mounted to the frame of the textile machine and a tube top guide rail 21 mounted to the frame of the textile machine. Each release guide plate 20 has an arcuate shape and is mounted with an upper end adjacent the vertical travel plane in which the belt 12 moves and a lower end vertically spaced from, and at a greater lateral spacing measured transversely to the vertical plane than, its upper end. The tube top guide rail 21 includes a horizontally extending portion disposed for engaging the exposed top portion of the tube 2' of a yarn package 2 supported on a respective one of the tube support members 1 in correspondence with the release of the tube support member 1 from the belt 12 by the release guide plates 20.

The release guide plates 20 and the tube top guide member 21 cooperate together to effect release of each tube support member 1 from its associated carrier member 13 as the tube support member travels past the guide roller 16 and begins descending as the belt 12 travels in its downward run. The upper ends of the pair of the release guide plates 20 engage respective circumferentially opposed positions on the annular ring 1''' of the tube support member 1 to be released and, in correspondence with this engagement, the exposed top portion of the tube 2' of the yarn package 2 on the tube support member is engaged by the horizontally extending portion of the tube top guide rail 21. As the belt 12 continues to lower the tube support member, the annular ring 1''' thereof slides along the arcuately shaped release guide plates 20 while the exposed top portion of the tube 2' moves in pivoting manner about the tube top guide rail 21. As the tube support member slides along the release guide plates 20, the release guide plates act to move the tube support member 1 laterally outwardly from the belt 12, thereby effecting release of the annular ring 1'', from the associated carrier member 13. As the tube support member slides laterally outwardly beyond the lower ends of the release guide plates 20, the tube support member is engaged by the belt 23 of the discharge transport component 22 and is transported thereby with the tube support member now oriented in a horizontal position and the full yarn package tube thereon oriented in a vertical disposition.

As seen in FIG. 1, the vertical transport component includes an offset guide roller 18 mounted to the frame of the textile machine at a location vertically intermediate the guide roller 14 and the guide roller 15. The offset guide roller 18 is offset inwardly from the guide roller 14 in the direction toward the drive roller 17 and acts to guide the belt 12 along a travel path tilted with respect to the vertical as the belt 12 travels past and beyond the feed location at which the tube support members 1 are transferred from the feed transport component 3 to the carrier members 13. The tilted travel path portion of the upward run of the belt 12 insures that each tube support member 1 transferred to a carrier member 13 is reliably moved out of clearance with the next following tube support member, thereby obviating the need for a feed control device at the feed location for controlling the feed of the tube support members to the belt 12.

The tube transport assembly illustrated in FIG. 1 and 2 operates as follows. The belt 4 of the feed transport component 3 transports the tube support members 1 with full yarn packages 2 supported in upright dispositions thereon to feed location for transfer to the vertical transport component. As the respective tube support member 1 to be transferred is transported beyond the downstream end of the belt 4 between the extending portions 5' of the guide walls 5, the notch 13' of the next oncoming carrier member 13 engages the annular ring 1''' of the tube support member, as seen in FIG. 2. Each adjacent pair of the spokes 1', the annular ring 1''', and the peg support portion 1'' form an opening and operate as a complimentary engagement portion of each tube support member 1 for cooperating with the post of a carrier member to effect re-orienting movement of the tube support member 1 from its feed location orientation to its more vertical orientation upon movement of the tube support member as the post of the carrier member enters the opening and lifts the tube support member.

As the respective carrier member 13 which has engaged the tube support member is moved upwardly by the belt 12 along its inclined travel path portion between the guide roller 14 and the offset guide roller 18, the belt 4 continues to advance the tube support member toward the belt 12 and these two movements combine to effect tilting of the now engaged tube support member 1 from its horizontal orientation on the belt 4 toward a vertical orientation. The transfer guide plate 6,7 engage circumferentially opposed surfaces of the annular ring 1''' of the tube support member 1 during this tilting movement, and thereby impart a lateral force to the tube support member 1 in a direction transverse to the vertical plane of the belt 12 to insure that the tube support member fully seats on the associated carrier member 13. The continuing movement of the associated carrier member 13 along the inclined travel path portion of the belt 12 insures that the engaged tube support member does not interfere with the engagement of the next following tube support member 1. Specifically, the travel of the engaged tube support member 1 along the inclined travel path portion of the belt 12 insures that the full yarn package tube, which is moved from an upright vertical disposition to a horizontal disposition in correspondence with the tilting of the tube support member, is out of clearance with the full yarn package 2 supported on the next following tube support member 1.

As the engaged tube support member is increasingly tilted, the transfer guide plate 6,7 laterally move the tube support member 1 into complete seating on the carrier member 13. Whereas the engaged tube support member initially pivots about the notch 13' of the associated carrier member 13 during the transfer operation, the action of the transfer guide plate 6,7 and, thereafter, the guide channels 11, act to push the tube support member beyond the notch 13' to be fully seated on the carrier member 13.

As the engaged tube support member 1 is transported along the upward run of the belt 12, the guide channels 11, which overlap portions of the top and bottom surfaces of the annular ring 1''' of the tube support member, guide the tube support member and act to maintain the tube support member in its vertical orientation. The engaged tube support member thereafter travels through the horizontal upper run of the belt 12 and is released by the release guide plates 20 and the tube top guide rail 21 onto the belt 23 of the discharge transport component 22 as the belt 12 commences its downward run.

FIG. 3 illustrates one variation of the tube transport assembly shown in FIG. 1 and 2 in which the tube transport assembly is provided with a plurality of tube support members 25 in lieu of the tube support members 1 and a plurality of carrier members 26 in lieu of the carrier members 13. Each tube support member 25 includes an annular portion 25' forming a cylindrical recess 25'. The annular circumferential portions 25'' are integrally formed with a solid top portion on which a peg 25''' is mounted co-axially with respect to the annular circumferential portion 25'' for supporting a full yarn package 2 inserted thereon.

Each carrier member 26 includes a post portion extending laterally outwardly from the belt 12 in a direction transverse to the vertical plane of movement of the belt 12 and a magnetic element 27 is mounted to the post portion and extends radially with respect thereto. The annular circumferential portion 25'' of each tube support member 25 is formed out of ferro magnetic material. Alternatively, the magnetic element 27 of each carrier member 26 can be formed of a ferro magnetic material and the annular circumferential portion 25" of each tube support member 25 can be correspondingly formed of magnetic material.

In operation, the carrier members 26 enter the cylindrical recess 25' of the respective tube support member 25 being transferred and the post portion of the respective carrier member 26 extending laterally beyond its magnetic element 27 engages the inner circumferential surface of the annular circumferential portion 25". The tilting of the respective tube support member 25 follows in the same manner as described with respect to the engagement of the tube support members 1 in the embodiment shown in FIGS. 1 and 2, and, as the orientation of the respective tube support member 25 increasingly approaches the vertical, the transfer guide plate 6,7 act to fully seat the tube support member 25 on the carrier member 26. The magnetic element 27 is appropriately spaced laterally inwardly from the free end of the carrier member 26 so that the bottom surface of the annular circumferential portion 25" of the tube support member 25 and the magnetic element 27 magnetically interact with one another when the tube support member 25 is fully seated on the carrier member 26. The magnetic interaction between the annular circumferential portion 25" and the magnetic element 27 enhances the stability of the tube support member 25 as it is transported by the belt 12.

The annular circumferential portion 25" of the tube support member 25 preferably includes an annular surface tapering radially inwardly relative to the tube support member in the direction toward the bottom of the tube support member for facilitating the transfer of the tube support members between the vertical transport components and the respective upper and lower horizontal transfer components.

Figure 4:
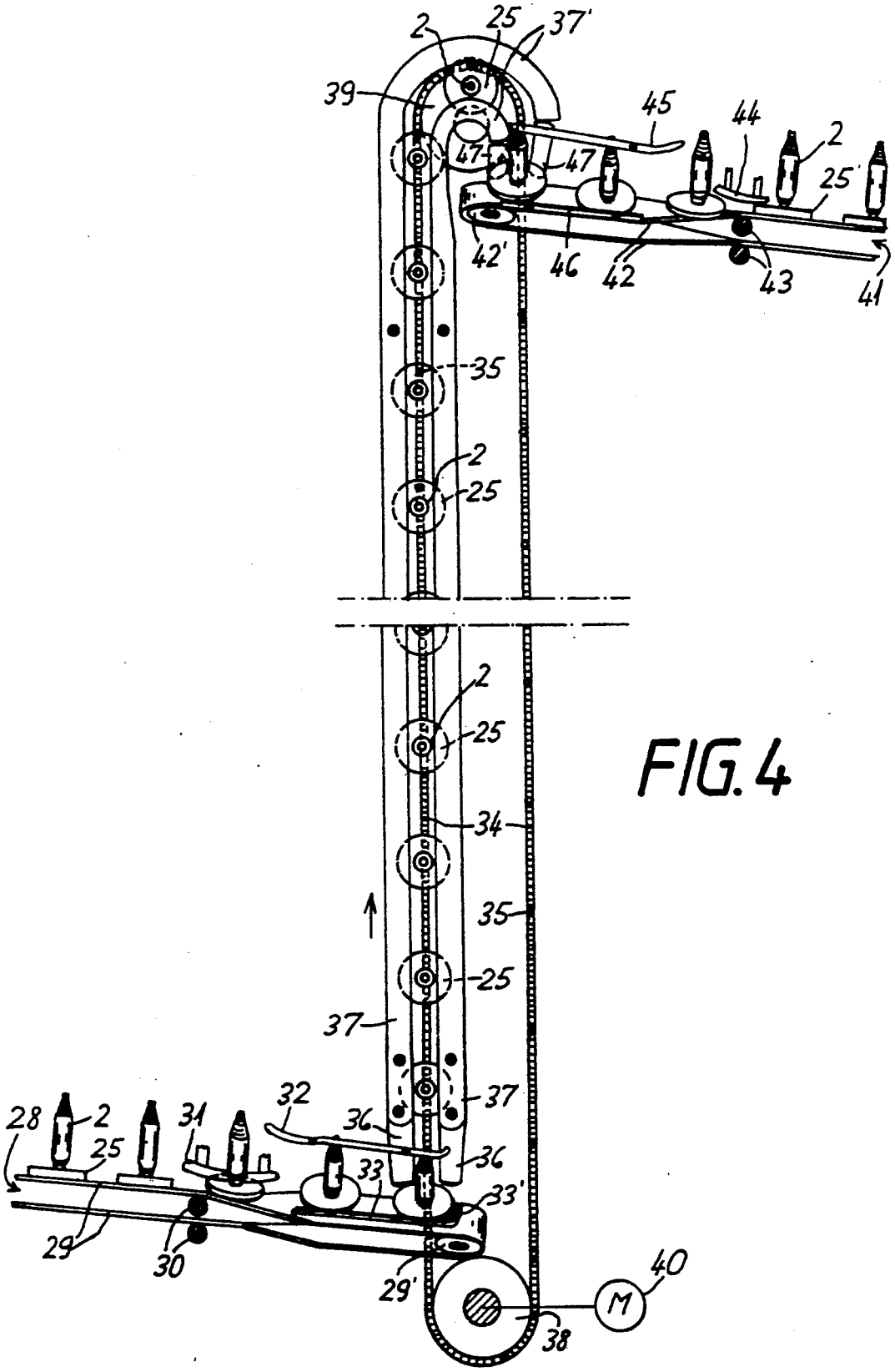
FIG. 4 is a front elevational view of another embodiment of the tube transport assembly of the present invention.
Figure 5:
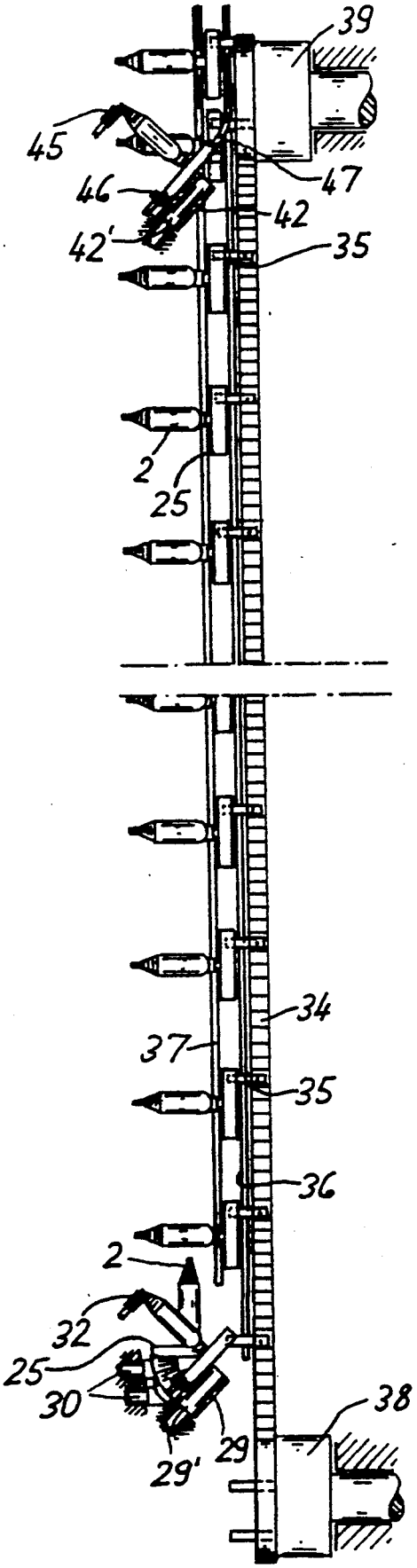
FIG. 5 is a side elevational view, in partial vertical section, of the tube transport assembly shown in FIG. 4.

In FIGS. 4 and 5, another embodiment of the tube transport assembly of the present invention is illustrated which provides the capability to vertically transport the tube support members between spaced vertical positions, thereby utilizing a minimum of floor space. A plurality of tube support members, which are preferably of the type illustrated in FIG. 3 having annular ferromagnetic components, are horizontally transported by a lower horizontal transport component 28 having a conventional flexible endless member or belt 29 trained around a guide roller 29' at its downstream end and around a conventional drive roller (not shown) operatively connected to a conventional drive motor (not shown) for driving operation of the belt 29. The tube support members are transferred from the lower horizontal transport component to a vertical transport component having carrier members and carrier member conveying means for conveying the tube support members between vertically spaced locations.

The lower horizontal transport component 18 includes means for inclining the lateral orientation of the belt 29 for corresponding inclined orientation of the tube support members at its downstream end. The lateral orientation inclining means includes a pair of guide rollers 30, each disposed upstream of the guide roller 29' for supporting a respective one of the upper and lower runs of the belt 29 and a belt twist stop member 31 positioned adjacent the rollers 30 above the upper run of the belt 29 and a means (not shown) for supporting the guide roller 29' with its axis at an inclination with respect to the horizontal. The belt twist stop member 31 is sufficiently spaced from the upper run of the belt 29 to permit passage therebetween of the tube support member 25 through frictional engagement of the tube support members by the belt 29 yet is positioned sufficiently close to the upper run of the belt 29 to exert a slight pressure through the tube support members 25 on the belt 29 to prevent twisting of the belt from a horizontal disposition upstream beyond the belt twist stop member.

As best seen in FIG. 5, the axis of the guide roller 29' is supported at an inclination such that the annular inclined ferromagnetic components of each tube support member 25 arriving at the downstream end of the belt 29 is oriented in a generally vertical transfer orientation for engagement by a carrier member for vertical movement of the engaged tube support member 25. The lower horizontal transport component additionally includes a transfer support member 32 for supporting the exposed upper end of each supported tube 2' during tilting of the tube support member 25 supporting the respective tube at the downstream end of the belt 29. The transfer support member 32 includes a contoured rail for supporting the exposed tube ends during the increasing tilting of the tube as the respective tube support member 25 travels toward the downstream transfer location. Additionally, the horizontal transport component includes a second transfer support member 33 for laterally orienting the tube support members 25 at the downstream end of the belt 29 and for preventing further downstream travel of the tube support members beyond a downstream transfer location at which the tube support members are magnetically engaged by carrier members for vertical movement of the tube support members.

The carrier members for engaging the tube support members 25 during their vertical transport are uniformly spaced on a carrier member conveying means which can be in the form, for example, of a conventional flexible endless member or belt 34 trained around a lower guide roller 38 and an upper drive roller 39, which is operatively connected to a conventional drive motor (not shown) for driving operation of the belt 34. Each carrier member 35 is in the form of a post extending laterally from the belt 34 in a direction transverse to the vertical plane in which the belt 34 travels. Each carrier member 35 enters the annual recess formed in the bottom of each tube support member 25 in the same manner as the carrier members 25 engage the tube support members 1 a discussed with respect to the embodiment of the tube transport assembly illustrated in FIGS. 1 and 2. A pair of transfer guiding plates 37 are mounted to the frame of the textile machine and extend parallel to the vertical plane in which the belt 34 travels offset laterally outwardly therefrom in a direction away from the belt 34 at a spacing from the vertical plane generally corresponding to the axial extent of the annular portion of a tube support member 25. The transfer guide plates 37 are spaced from one another by an amount sufficient to permit the passage therebetween of a tube 2' and/or a yarn package 2 supported on a tube support member 2" being transported by one of the carrier members. The guide plates 37 insure that the tube support members 25 are reliably mounted on each carrier member following the transfer of the respective tube support member 25' to the respective carrier member at the downstream transfer location.

The vertical transport component additionally includes a pair of arcuately shaped guide plates 37' disposed in the same vertical plane as the transfer guide plates 37 and mounted to the textile machine at a spacing from one another at the location at which the belt 34 is trained around the drive roller 39. The pair of guide plates 37' are spaced from one another by an amount sufficient to permit passage therebetween of a tube 2' and/or a yarn package 2 supported on a tube support member 25 being carried by a carrier member. The guide plates 37' insure that the tube support members 25 being carried by the carrier members remain stably mounted on the carrier members as the carrier members travel along the semi-circular travel path at the top of the upwardly moving run of the belt 34.

The vertical transport component further includes an upper horizontal transport component 41 for receiving tube support members 25 at the vertical upstream transfer location and transporting the tube support members along a horizontal transport path extending at a higher elevation than the horizontal path of the lower horizontal transport component. The upper horizontal transport component 41 includes an endless member or belt assembly having a flexible endless belt 42 trained around a guide roller 42' and a conventional guide roller (not shown), which is operatively connected to a conventional drive motor (not shown) for driving operation of the belt 42. The upper horizontal transport component additionally includes means for inclining the lateral orientation of the belt 42 transversely to its endless extent from a horizontal orientation to an inclined orientation at the upstream transfer location for receiving inclined tube support members 25' transferred thereto from the carrier members.

The lateral orientation inclining means includes a pair of belt rollers 43, each positioned for supporting the bottom of a respective one of the upper and lower runs of the belt 42 at a common location downstream of the upstream transfer location, a belt twist block member 44 positioned at the location of the belt rollers 43 and mounting means (not shown) for mounting the guide roller 42' to the frame of the textile machine with the axis of the guide roller inclined relative to the horizontal. The belt twist stop member 44 is spaced from the upper run of the belt 42 by a spacing sufficient to permit passage therebetween of the annular base portion of a tube support member 25 yet sufficiently closely adjacent the belt 42 to apply a downward pressure through the annular base portion of the tube support member 25 passing therebetween to the belt 42, which is supported at the pressure receiving location by one of the belt rollers 43.

The upper horizontal transport component 41 further includes an upper release means for releasing each tube support member 25 supported on a carrier member as the tube support member commences travel downwardly during the downward run of the belt 34. The upper release means includes a pair of tapered members 47 positioned on respective opposite lateral sides of the belt 34 and tapering outwardly therefrom. The tapered members 47 are laterally spaced from one another by an amount sufficient to permit passage therebetween of the carrier members and less than the extent of a tube support member 25. The tapered wedge members 47 are positioned intermediate the guide plates 37' and the upper run of the belt 42 at the vertical upstream transfer location adjacent to the top of the downward run of the belt 34. Thus, the tapered members engage the passing tube support members 25 to cause the tube support members to move laterally outwardly from their associated supporting carrier members to thereby effect release of the tube support members at an inclination for sliding onto the belt 42 of the upper horizontal transport component 41.

The upper horizontal transport component 41 additionally includes an upper transfer support means having a contoured rail 45 mounted to the frame of the textile machine at the upstream transfer location and contoured for continuously supporting an exposed upper end of a tube 2' supported on a tube support member 25 being transferred onto the belt 42 during inclining of the tube in correspondence with the movement of the respective tube support member 25 from an inclined transfer orientation to a horizontal orientation. Additionally, a lateral guide rail 46 is mounted to the frame of the textile machine and extends along the upper run of the belt 42 at the upstream transfer location for laterally orienting tube support members 25 supported on the belt 42.

The carrier members are spaced from one another relative to the endless extent of the belt 34 at a uniform spacing sufficient to insure that the tube support member 25 most recently engaged by a carrier member has been transferred sufficiently beyond the downstream transfer location to avoid interference with the next following tube support member 25 being loaded onto the next following carrier member at the downstream transfer location. The engaged tube support members 25 are transported along the guide plates 37' as the belt 34 travels in a semi-circular path from its upwardly moving run to its downwardly moving run and the guide plates 37' insure that the engaged tube support members 25 remain stably engaged by the carrier members during this travel. As each engaged tube support member 25 travels beyond the guide plates 37', the respective carrier member passes between the tapered members 47 which engage the bottom surface of the engaged tube support member and move the tube support member progressively laterally outwardly out of engagement with the carrier member as the carrier member travels between the tapered members 47. As seen in FIG. 4, the now-disengaged tube support member is oriented at a transfer inclination by the tapered members 47 parallel to the inclination of the belt 42 of the upper horizontal transport run component at the upstream location. Accordingly, the tube support member slides along the tapered members 47 onto the upstream end of the belt 42 and its lowermost portion is engaged by the lateral orientation member 46 to laterally orient the tube support member as the belt 42 begins to transport the tube support member. The contoured rail 45 guides the exposed upper end of the tube supported on the tube support member as the tube support member moves during its change of orientation from the inclined transfer orientation to a horizontal orientation. The tube support member passes between a belt twist stop member 44 and the belt roller 43 while supported on the belt 42 and travels thereafter in a horizontal orientation on the belt 42 toward a further handling location.

Figure 6:
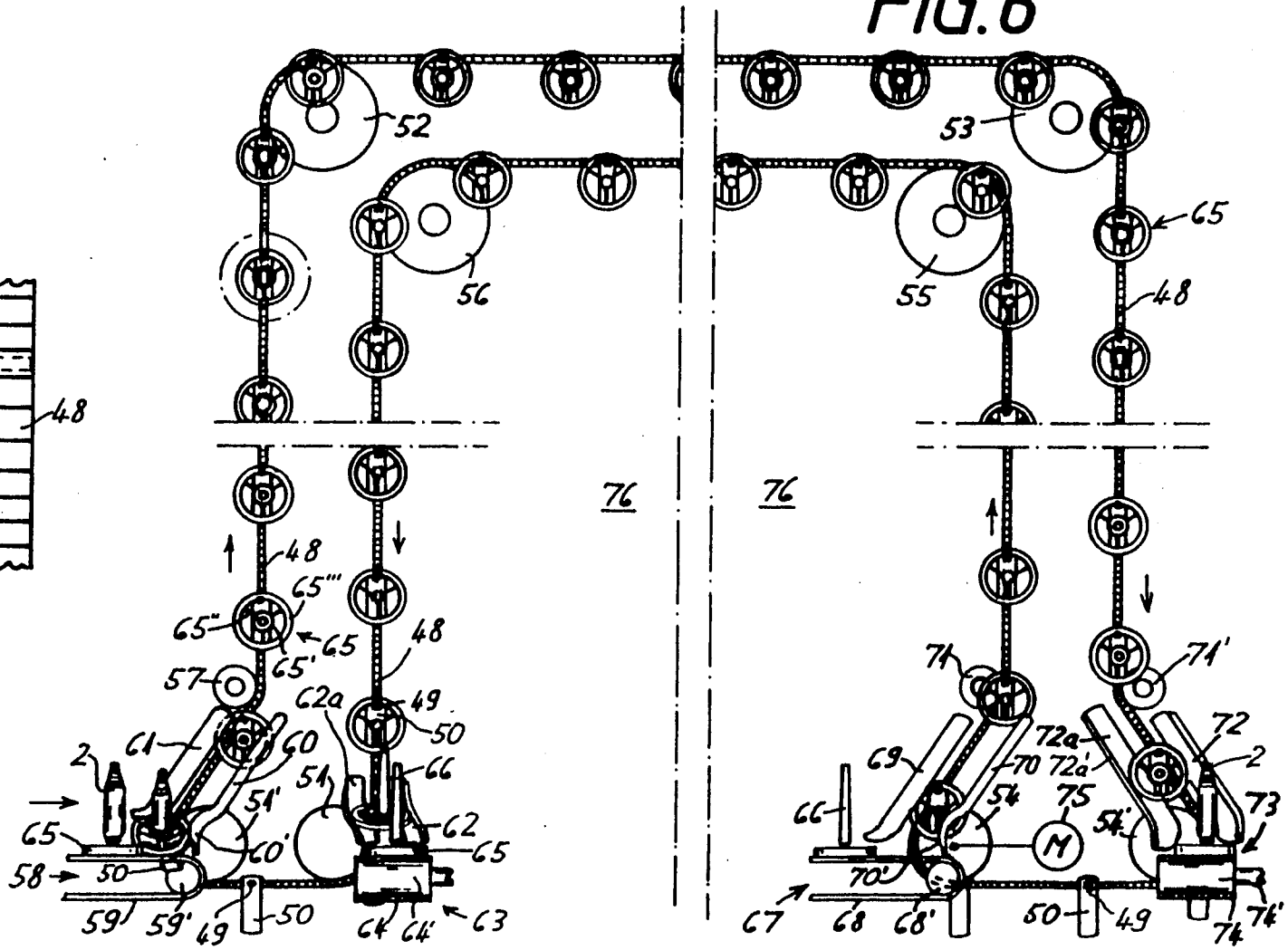
FIG. 6 is a front elevational view of a further embodiment of the tube transport assembly of the present invention.
Figure 7:
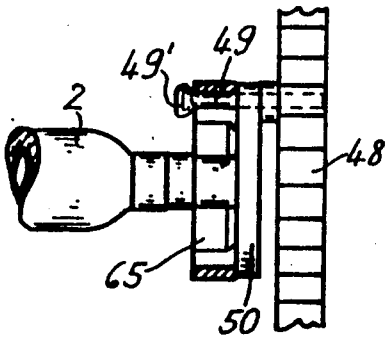
FIG. 7 is an enlarged side elevational view, in partial vertical section, of a portion of the tube transport assembly shown in FIG. 6.

In FIGS. 6 and 7, a further embodiment of the tube transport assembly of the present invention is illustrated. The tube transport assembly includes a first feed transport component 58 having a conventional flexible endless member or belt 59 trained around a guide roller 59' and a conventional drive roller (not shown) which is operatively connected to a conventional belt drive motor (not shown) for driving operation of the belt 59. The first feed transport component 58 is operable to transport a plurality of tube support members 65, each supporting a full yarn package 2 in an upright disposition, to a first upstream transfer or feed location for transfer to a bridge transport component for bridging travel over a service passageway 76 located between, for example, a pair of adjacent textile machines.

The bridge transport component includes a conventional flexible endless member or belt 48 trained around a plurality of guide rollers 51, 51', 52, 53, 54', 55, and 56 and a drive roller 54 for endless travel in a travel path which extends between the upstream transfer location and a first downstream transfer or discharge location on an opposite side of the service passageway 76 for transfer of the tube support member 65 to a first discharge transport component 73. The second feed transport component 67 includes a conventional flexible endless member or belt 68 trained around a guide roller 68' and a conventional drive roller (not shown), which is operatively connected to a conventional drive motor (not shown) for driving operation of the belt 68.

The first discharge transport component 73 includes a flexible endless member or belt 74 trained around a guide roller 74' and a conventional driver roller (not shown), which is operatively connected to a conventional drive motor (not shown) for driving operation of the belt 74.

The second transport component 63 includes a conventional flexible endless member or belt 64 trained around a guide roller 64' and conventional drive roller (not shown), which is operatively connected to a conventional drive motor (not shown) for driving operation of the belt 64.

The drive roller 54 is operatively connected to a conventional belt drive motor 75 for driving operation of the belt 48.

The bridge transport component is also operable to transport the tube support members 65, each supporting an empty tube 66 thereon, from a second feed transport component 67 on the opposite side of the service passageway 76 to a second discharge transport component 63 on the one side of the service passageway 76 for transfer of the tube support members thereto. The second feed transport component 67 transports tube support members 65, each supporting an empty tube 66 in an upright disposition thereon, to the bridge transport component for transport thereby over the service passageway 76 to the second discharge transport component 63. The second discharge transport component 63 transports the tube support members 65 with the empty tubes 66 thereon to the textile spinning machine for the building of new full yarn packages 2 on the empty tubes.

The first feed transport component 58 and the second feed transport component 67 each include a pair of transfer plates 60, 61, and 69–70, respectively, for cooperating with the belt 48 to effect transfer of a tube support member 65 from the respective transport component onto a respective one of a plurality of carrier members 49 mounted to the belt 4 for transport of the tube support members 65 by the bridge transport component. The transfer guide plate 60,70 includes a stop portion 60',70', respectively, formed on its lower end and disposed adjacent the downstream end of the belt 59,68, respectively, for preventing further movement of each arriving tube support members 65 in the direction of movement of the belt 59,68, respectively. The stop portion 60',70' includes a curved profile for cooperating with the other opposed transfer guide plates 61,69, respectively, to promote sliding movement of each arriving tube support member 65 between the respective pair of transfer guide plates. Each respective pair of transfer guide plates 60,61 and 69,70 are mounted to the frame of the textile machine at an orientation in which the transfer guide plate taper laterally inwardly toward the vertical plane in which the belt 48 travels from the lower portion of the transfer guide plate towards its upper portion. This tapering orientation of the transfer guide plates insures that each tube support member 65 transferred to the belt 48 is fully and securely seated on the respective carrier member 49. The bridge transport component also includes a first offset guide roller 57, a second offset guide roller 71, and third offset guide roller 71'. The first offset guide roller 57 cooperates with the guide roller 51' to dispose the belt 48 in an inclined travel path at an incline from the vertical as the belt 48 travels between the transfer guide plates 60,61 of the first horizontal feed transport component 58. The second offset guide roller 71 cooperates with the drive roller 54 to guide the belt 48 in an inclined travel path during its travel between the drive roller 54 and the second offset guide roller 71. The third offset guide roller 71' cooperates with the guide roller 54' to guide the belt 48 in an inclined travel path inclined from the vertical as the belt travels from the third offset guide roller 71' to the guide roller 54.

As seen in particular in FIG. 7, each carrier member 49 includes a post portion projecting laterally from the belt 48 and having an enlarged free end portion 49'. Additionally, each carrier member 49 includes a stabilizing plate 60 fixedly mounted to the post portion of the carrier member and extending parallel to the vertical plane in which the belt 48 travels.

Each tube support member 65 includes an annular ring 65''', a plurality of spoke members 65'', and a peg portion 65'. The spoke members 65'' each have one end fixedly mounted to the inner circumference of the annular ring 65''' and an opposite end fixedly mounted to the peg portion 65' for supporting the peg portion 65' coaxially with the annular ring 65'''. Each spoke member 65'' is at an angle of 120° from each of the adjacent spoke members and the region between each adjacent pair of spoke members is open for insertion of the post portion of a carrier member 39 therethrough. Each spoke member 65'' is preferably formed with an inwardly tapering bottom surface for facilitating insertion of the post portion of a carrier member 49 between an adjacent pair of the spoke member 65''.

The enlarged free end portion 49' of each carrier member 49, as seen in FIG. 7, resists lateral outward movement of the respective tube support members 65 supported on the carrier member and encourages laterally inward movement of the tube support member against the stabilizing plate 50 of the carrier member, whereby the respective tube support member is stably supported during its transport on the carrier member 49. To insure stable support of each tube support member 65 by its associated carrier member 49, the post portion of the carrier member should be pivotally mounted to the belt 48 or, alternatively, the stabilizing plate 50 should be pivotally mounted to the post portion of the carrier member.

The first discharge transport component 73 and the second discharge transport component 63 each include a pair of transfer guide plates **62*a*, 66, and 72*a*, 72, respectively for effecting transfer of tube support members 65 supported on the belt 48 to the respective transport component. The transfer guide plate 62a,66 of the second discharge transport component 63 are each mounted to the frame of a textile machine and are inclined downwardly from their upper end toward their lower end in a direction laterally outwardly from the vertical plane in which the belt 48 travels. The transfer guide plates 62a,62 are spaced from one another for passage therebetween of the belt 48 and each includes a side wall for guiding of the tube support members 65 transferred thereto from the belt 48 during sliding movement of the tube support members along the transfer guide plates. The lower ends of the transfer guide plates 62a,62 are disposed adjacent the upstream end of the belt 64 for sliding movement of the tube support member 65 supported on the transfer guide plates smoothly onto the top run of the belt 64** for transport by the belt to a further location.

The transfer guide plates 72,72a of the first discharge transport component 73 are inclined laterally outwardly relative to the vertical plane in which the belt 48 travels in a direction from the top to the bottom of the guide plates for promoting sliding movement therealong of the tube support member 65 transferred to the guide plates from the belt 48. The transfer guide plate 72,72a are mounted in spaced-apart disposition for travel of the belt 48 therebetween as the belt travels along its incline travel path portion extending from the third offset guide roller 71' to the guide roller 54'. Each transfer guide plate 72,72a includes a wall portion such as, for example, the wall portion 72a' of the transfer guide plate 72a for maintaining each transferred tube support member 65 in centered disposition on the transfer guide plates during sliding movement therealong. The lower ends of the transfer guide plates 72,72a are disposed adjacent the top run of the belt 74 for sliding movement of the tube support members 65 beyond the transfer guide plates onto the top run of belt 74. The positioning of the transfer guide plates 72,72a along the incline travel portion of the belt 48 insures that each tube support member 65 transferred onto the transfer guide plates is offset from the respective tube support members 65 which had just previously been transferred to the transfer guide plates, thereby insuring that the respective full packages 2 supported on the two tube support members 65 are out of interference with one another.

The first feed transport component 58 transports tube support member 65, each supporting a full yarn package 2 in an 15 upright disposition thereon, from a textile spinning machine (not shown) to the bridge transport component for transport of the tube support members 65 to the first discharge transport component 73. The first discharge transport component 73 transports the tube support members 65 with the full yarn packages 2 thereon to a textile winding machine (not shown) for further handling of the full yarn packages 2 thereat.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. An assembly for transporting tubes in association with a textile machine, the tubes being of the type on which yarn is wound, comprising:

a plurality of tube support members, each tube support member for individually supporting a tube thereon in a fixed disposition relative to the tube support member and each tube support member having an engagement portion;

a vertical transport component for transporting tube support members along a transport path which includes at least one portion extending between vertically spaced locations, the vertical transport component including a carrier member conveying means operable to travel in an endless loop between a feed location at which tube support members are transferred to the carrier member conveying means and a discharge location at which tube support members being transported by the carrier member conveying means are transferred therefrom, the endless loop in which the carrier member conveying means travels defining a travel plane and the carrier member conveying means traveling upwardly at the feed location and traveling downwardly at the discharge location, and a plurality of carrier members secured to the carrier member conveying means at spacings therealong, each carrier member for individually supporting a tube support member during transport of the tube support member by the carrier member conveying means, and each carrier member having a re-orientation movement support portion for cooperating with the engagement portion of a tube support member to support the tube support member during a re-orienting movement thereof in which the tube support member moves relative to the carrier member from its feed position orientation to a travel position orientation in which the tube support member is oriented at a greater angle relative to the horizontal;

means for supporting tube support members at the feed location in position for sequential individual engagement of each tube support member by a respective one of the carrier members;

means for guiding each tube support member in the lateral direction during upward movement of the tube support member at the feed location in correspondence with the engagement of the tube support member by a respective carrier member, the guiding means effecting complete seating of the engaged tube support member on the respective carrier member; and means for effecting release of tube support members from the downwardly moving carrier members at the discharge location.

2. An assembly according to claim 1 wherein the engagement portion of each tube support member includes an opening on the bottom of the tube support member and the re-orienting movement support portion of each carrier member is adapted to be inserted within the opening of each tube support member during movement of the carrier member past the feed location for initial engagement of the tube support member by the carrier member.

3. An assembly according to claim 1 comprised wherein the engagement portion of each tube support member includes an outer member, an inner member, and a plurality of spoke members interconnecting the inner member to the outer member at a spacing therebetween, each adjacent pair of the spoke members, the outer member, and the inner member forming an opening for the insertion therein of the re-orienting movement support portion of a carrier member for initial engagement of the tube support member by the carrier member.

4. An assembly according to claim 1 and further comprising a feed transport component having a flexible endless member for traveling support of tube support members thereon, the flexible endless member extending to the feed location for the transport of tube support members to the feed location and means for inclining the orientation of the flexible endless member relative to the horizontal at the feed location for transfer o tube support members in inclined orientation to the carrier members.

5. An assembly according to claim 1 and further comprising means for releasably maintaining a tube support member at the feed location in position for engagement of the tube support member by a carrier member.

6. An assembly according to claim 1 wherein the means for guiding each tube support member includes a pair of transfer guide plates, the transfer guide plates being spaced apart from one another for travel of the carrier member conveying means therebetween, and each transfer guide plate extending laterally outwardly from the travel plane in the direction from its upper end toward its lower end.

7. An assembly according to claim 6 and further comprising a guide roller and an offset guide roller, the guide roller and the offset guide roller cooperating together to guide the carrier member conveying means in a portion of the transport path which is inclined with respect to the vertical, the inclined transport path portion extending between the spaced-apart transfer guide plates.

8. An assembly according to claim 1 wherein the vertical transport component includes a guide roller and an offset guide roller, the carrier member conveying means being trained around the guide roller and the offset guide roller, and the guide roller and the offset guide roller cooperating together to guide the carrier conveying means in an inclined travel path inclined from the vertical at the outgoing transfer location.

9. An assembly according to claim 6 further comprising means for resilient mounting one of the transfer guide plates for resilient movement of the transfer guide plate in a lateral direction transverse to the travel plane.

10. An assembly according to claim 1 wherein the means for releasing tube support members from the carrier member conveying means at the discharge location includes a release guide plate member having an upper end disposed adjacent the carrier member conveying means at the discharge location and a lower end spaced laterally outwardly from, and lower than, the upper end, the release guide plate member engaging the underside of each tube support member traveling in the downward run of the carrier member conveying means at the discharge location and being operable to move each engaged tube support member laterally outwardly beyond the associated carrier member on which it is supported to thereby effect transfer of the engaged tube support member from the vertical transport component.

11. An assembly according to claim 10 and further comprising a discharge transport component for transporting tube support members transferred from the vertical transport component at the discharge location, the discharge transport component having a substantially horizontal surface for supporting tube support members thereon, and wherein the lower end of the release guide plate member tapers at an increasingly reduced angle relative to the horizontal for effecting relatively smooth transfer of tube support members from the lower end of the release guide plate member onto the substantially horizontal surface of the discharge transport component.

12. An assembly according to claim 10 wherein the release guide plate member includes a wall portion for maintaining each tube support member in a fully supported disposition on the release guide plate during movement of the tube support member along the release guide plate member from its upper end toward its lower end.

13. An assembly according to claim 1 wherein the means for supporting tube support members at the feed location includes a pair of support plates, each support plate being mounted on a respective side of the transport path of the carrier member conveying means at the feed location, and the support plates being operable to engage the bottom of each tube support member during transfer of the tube support member onto a carrier member at the feed location to thereby stabilize the tube support member during its engagement by the carrier member.

14. An assembly according to claim 1 wherein in each tube support member has a ferro magnetic component and each carrier member has a magnetic component operable to magnetically interact with the ferro magnetic component of a tube support member engaged by the carrier member to thereby minimize relative movement between the carrier member and the respective tube support member supported thereon during movement of the carrier member and the tube support member by the carrier member conveying means.

15. An assembly according to claim 2 wherein the re-orienting movement support portion of each carrier member includes a radially enlarged segment for counteracting laterally outward movement of a tube support member supported on the carrier member.

16. An assembly according to claim 1 wherein each tube support member has a base portion having a top and bottom and further comprising means forming a pair of guide channels, each guide channel being positioned on a respective opposite side of at least a portion of the travel path of the tube support members during transport thereof by the vertical transport component, the guide channels being spaced apart from one another in a direction parallel to the travel plane by an amount sufficient to permit travel therebetween of the carrier member conveying means, and each guide channel having surfaces for engaging at least the top and bottom of the base portion of each tube support member to effect guiding thereof 17. An assembly according to claim 1 wherein the re-orienting movement support portion of each carrier member includes means defining a notch for initially engaging a tube support member, the notch being open in the direction of travel of the carrier member conveying means at the feed location for receiving therein a portion of a tube support member to thereby reduce the risk of lateral outward movement of the tube support member beyond the re-orienting movement support portion of the carrier member.

18. An assembly according to claim 1 wherein the vertical transport component includes a plurality of guide rollers for guiding the carrier member conveying means in the transport path, the guide rollers guiding the carrier member conveying means in a first upward run on one side of a service passageway, a first horizontal run extending over the service passageway, a first downward run, a second upper run on the opposite side of the service passageway, a second horizontal run over the service passageway, and a second downward run on the one side of the service passageway, whereby the vertical transport component transports tube support members in bridging manner over the service passageway.

19. An assembly according to claim 1 and further comprising a second vertical transport component including a second carrier member conveying means having at least one vertical run, the second vertical transport component for transporting tube support members between a second feed location and a second discharge location and an interconnecting horizontal transport component extending between and interconnecting the vertical transport component and the second vertical transport component to one another, the interconnecting horizontal transport component being at a vertical spacing above the feed location and the second feed location.

20. An assembly according to claim 18 and further comprising means for transferring tube support members from the second downward run of the carrier member conveying means and means for feeding tube support members to the carrier member conveying means at a second feed location, the feed location and the second discharge location being located on the same side of the service passageway and the second feed location and the discharge location being located on the opposite side of the service passage way as the feed location in the second discharge location.

* * * * *